US006179246B1

(12) United States Patent
Fisel et al.

(10) Patent No.: US 6,179,246 B1
(45) Date of Patent: Jan. 30, 2001

(54) SEEKER HEAD FOR TARGET TRACKING MISSILES

(75) Inventors: Herbert Fisel, Owingen; Ulrich Hartmann, Uhldingen, both of (DE)

(73) Assignee: Bodenseewerk Geratetechnik GmbH, Uberlingen/Bodensee (DE)

( * ) Notice: Under 35 U.S.C. 154(b), the term of this patent shall be extended for 0 days.

(21) Appl. No.: 09/196,246

(22) Filed: Nov. 20, 1998

(30) Foreign Application Priority Data

Dec. 19, 1997 (DE) ..... 197 56 763

(51) Int. Cl.[7] ..... F41G 7/22
(52) U.S. Cl. ..... 244/3.16; 244/3.15
(58) Field of Search ..... 244/3.15, 3.16, 244/3.17, 3.18, 3.19, 3.2, 3.21, 3.22

(56) References Cited

U.S. PATENT DOCUMENTS 5,702,068 * 12/1997 Stoll et al. ..... 244/3.16

FOREIGN PATENT DOCUMENTS 28 41 748 C1 7/1996 (DE) .
0 653 600 A1 10/1994 (EP) .
0 714 013 A1 5/1996 (EP) .
0 797 068 A2 9/1997 (EP) .
2 632 072 8/1985 (FR) .

* cited by examiner

*Primary Examiner*—Bernarr E. Gregory
(74) *Attorney, Agent, or Firm*—McDermott, Will & Emery

(57) ABSTRACT

The invention relates to a seeker head for target tracking missiles having an image resolving seeker being gimbal suspended in a seeker gimbal assembly and adapted to be aligned to a target by target deviation signals, and inertial sensors. A virtual inertially stabilized reference coordinate system is adapted to be defined from signals from the image resolving seeker and from the seeker gimbal assembly, said stabilized reference coordinate system having an axis aligned to said target. The stabilized reference coordinate system is adapted to be aligned to predicted target positions in case of deterioration of the tracking function of the seeker to the target in accordance with the line of sight information (e.g. direction, angular rate, angular acceleration) of the reference coordinate system then present. The seeker is adapted to be aligned to the axis of the reference coordinate system when the deterioration ceases, the signals from the seeker taking over the tracking function of the seeker again.

10 Claims, 5 Drawing Sheets

SEEKER HEAD FOR TARGET TRACKING MISSILES

BACKGROUND OF THE INVENTION

This invention relates to a seeker head for target tracking missiles having an image resolving seeker being gimbal suspended in a seeker gimbal assembly and adapted to be aligned to a target by target deviation signals, and inertial sensors, Target tracking missiles are known having an image resolving sensor, e.g. in the form of a detector matrix having a two-dimensional array of detector elements. This seeker is gimbal suspended in a seeker gimbal assembly. Inertial sensors respond to the angular movements of the missile in inertial space. Torquers act on the gimbals of the seeker gimbal assembly and decouple the seeker from the thus determined angular movements of the missile. An image of an object scene is generated on the detector matrix. Target deviation data of a target located in the object scene, e.g. an enemy aircraft to be attacked, are generated by image processing of this image. The target deviation data represent the deviation of the target from an optical axis of the seeker. By means of these target deviation data the seeker tracks the target. From the tracking the angular rate of the line of sight is determined. From the angular rate of the line of sight, in turn, steering signals for the missile are derived. By means of a helmet visor a target recognized by the pilot is designated to the seeker. The missile is guided to this target in the described manner.

During air combats with close curves ("close-in-combat") it is desirable to detect a target even at a large look angle of the seeker. However, the look angle of the seeker is, of course, limited by the design. During air combats with close curves, situations can arise, in which the target occurs under an angle of vision, which is larger than the maximum allowable look angle of the seeker. Then the target cannot be designated to the seeker head. During the further course of the curved flight, the angle of sight can be reduced to a value below the maximum allowable look angle. Then the target can be designated to the seeker head and the missile can be fired. The earlier this is made, the greater are the chances of hitting the target. If, however, the missile is fired, then it first has the tendency to align aerodynamically with the direction of the velocity vector of the missile. Then the angle of vision to the target can again exceed the maximum allowable look angle of the seeker, such that the target gets lost. The target can also be covered temporarily by clouds.

SUMMARY OF THE INVENTION

One of the objects of the present invention is hence to provide a seeker head for target tracking missiles such that, even when the target tracking is disturbed for a short time, the seeker is re-aligned to the target as soon as the disturbance ceases.

This object is achieved in that a virtual inertially stabilized reference coordinate system is defined from signals from the image resolving seeker and from the seeker gimbal assembly, the stabilized reference coordinate system having an axis pointing to said target, the stabilized reference coordinate system is caused to point to predicted target positions, in case of disturbance of the target-tracking function of the seeker, in accordance with the line of sight information (e.g. direction, angular rate, angular acceleration) of said reference coordinate system then present, and the seeker is aligned with the axis of the reference coordinate system, when the disturbance ceases, the signals from the seeker resuming the tracking function of the seeker again.

Thus, according to the invention, a reference coordinate system is permanently defined, the axis of which points to the target. This is a type of "virtual" seeker. Normally, this reference coordinate system follows the target in the same manner as the seeker tracks the target from the deviation data. If the tracking movement of the seeker to the target is deteriorated, e.g. when the seeker attains its maximum allowable look angle or when the seeker temporarily cannot "see" the target anymore due to clouds, the reference coordinate system tracks a predicted target position. The predicted target position is determined by a kind of extrapolation from the line of sight information determined immediately before the deterioration occurs. When the deterioration then ceases, that means, for example, that the target occurs under an angle of vision falling below the maximum allowable look angle again, the seeker is aligned with the reference coordinate system. Then the seeker again detects the target, which target has been lost for a short time in its field of view. Then the seeker again tracks the target exactly by means of the deviation data supplied by the image processing.

Further objects and features of the invention will be apparent to a person skilled in the art from the following specification of a preferred embodiment when read in conjunction with the appended claims.

BRIEF DESCRIPTION OF THE DRAWING

The invention and its mode of operation will be more clearly understood from the following detailed description when read with the appended drawing in which.

Figure 5:
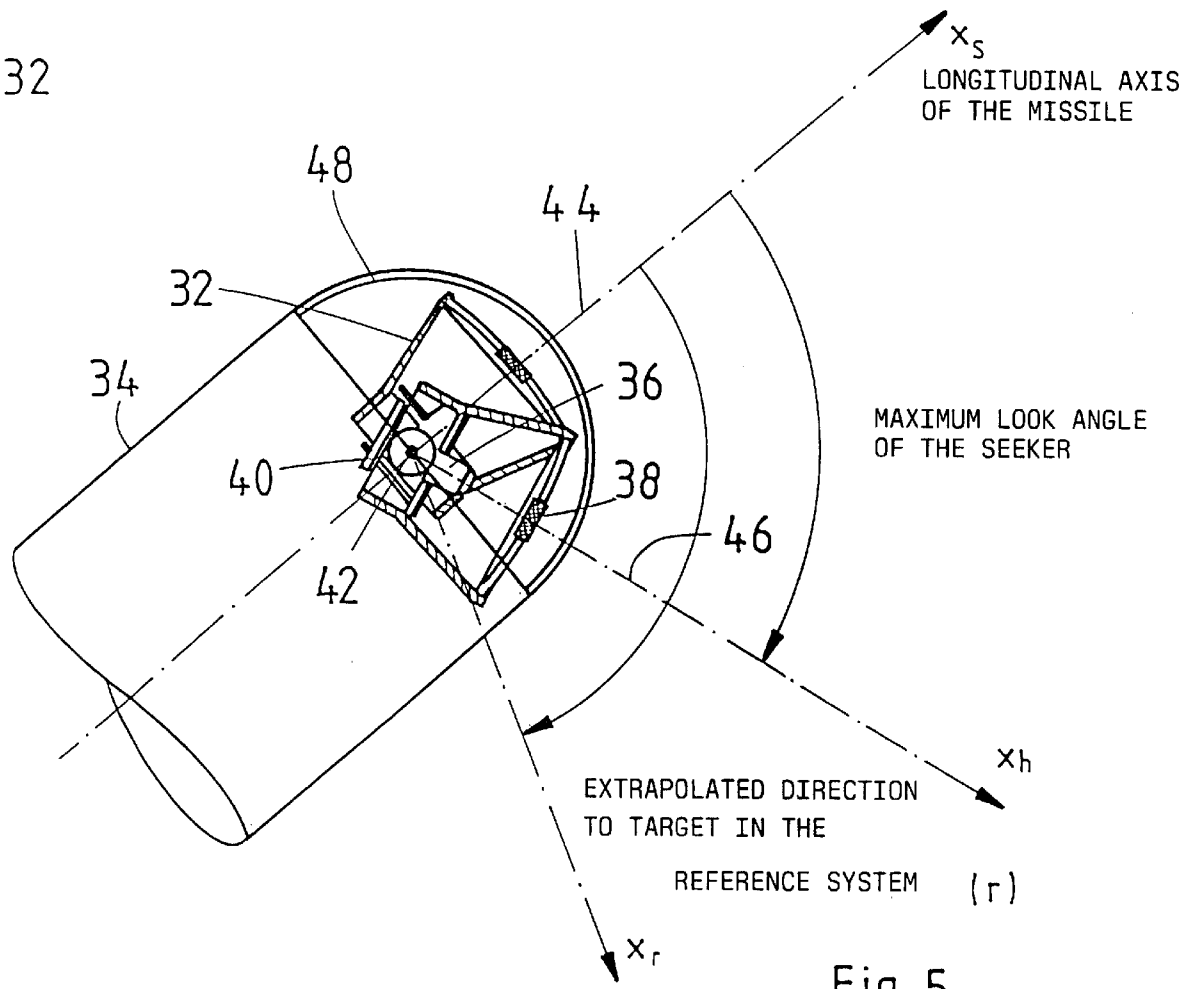
Figure 6:
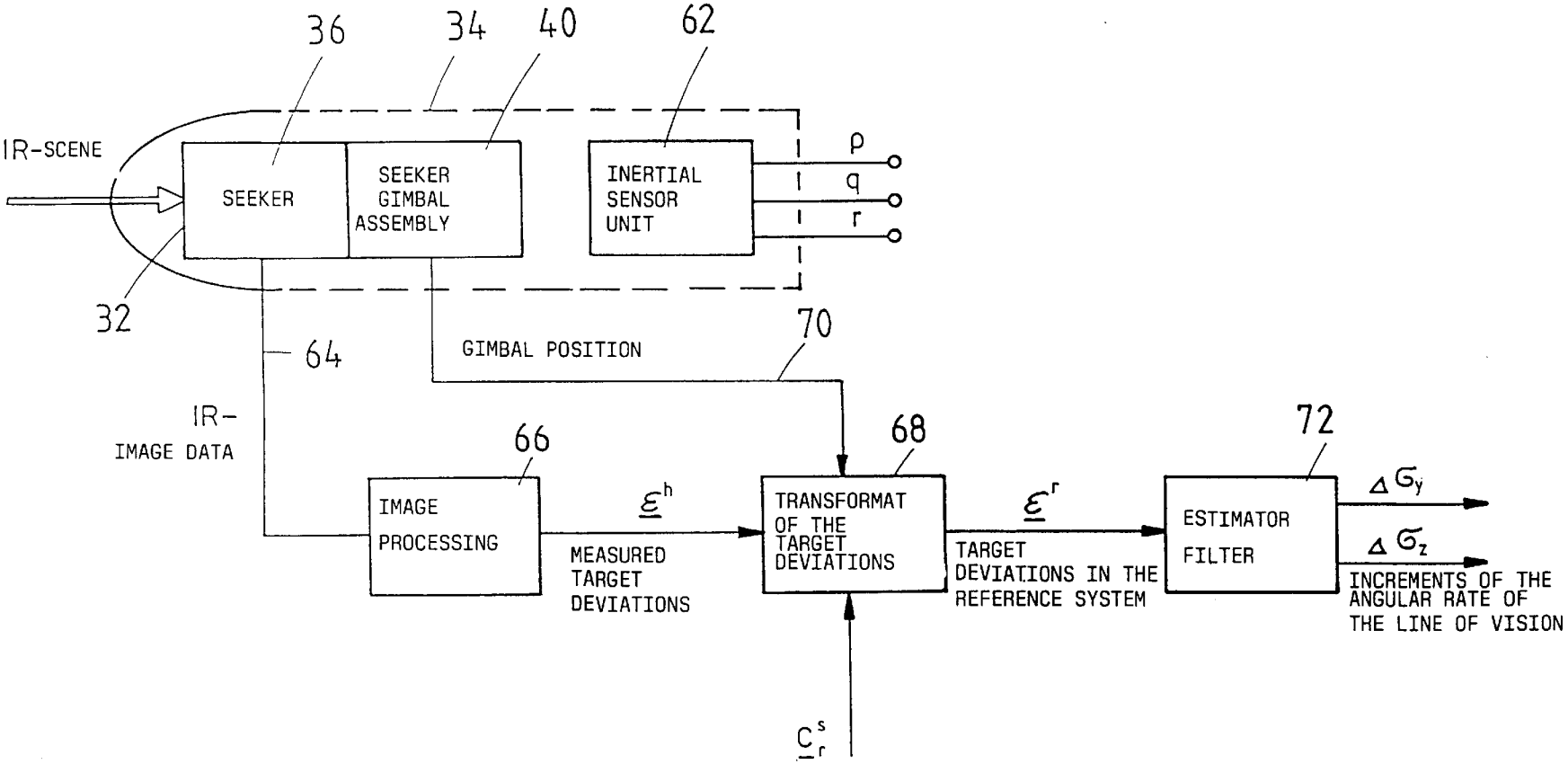
Figure 7:
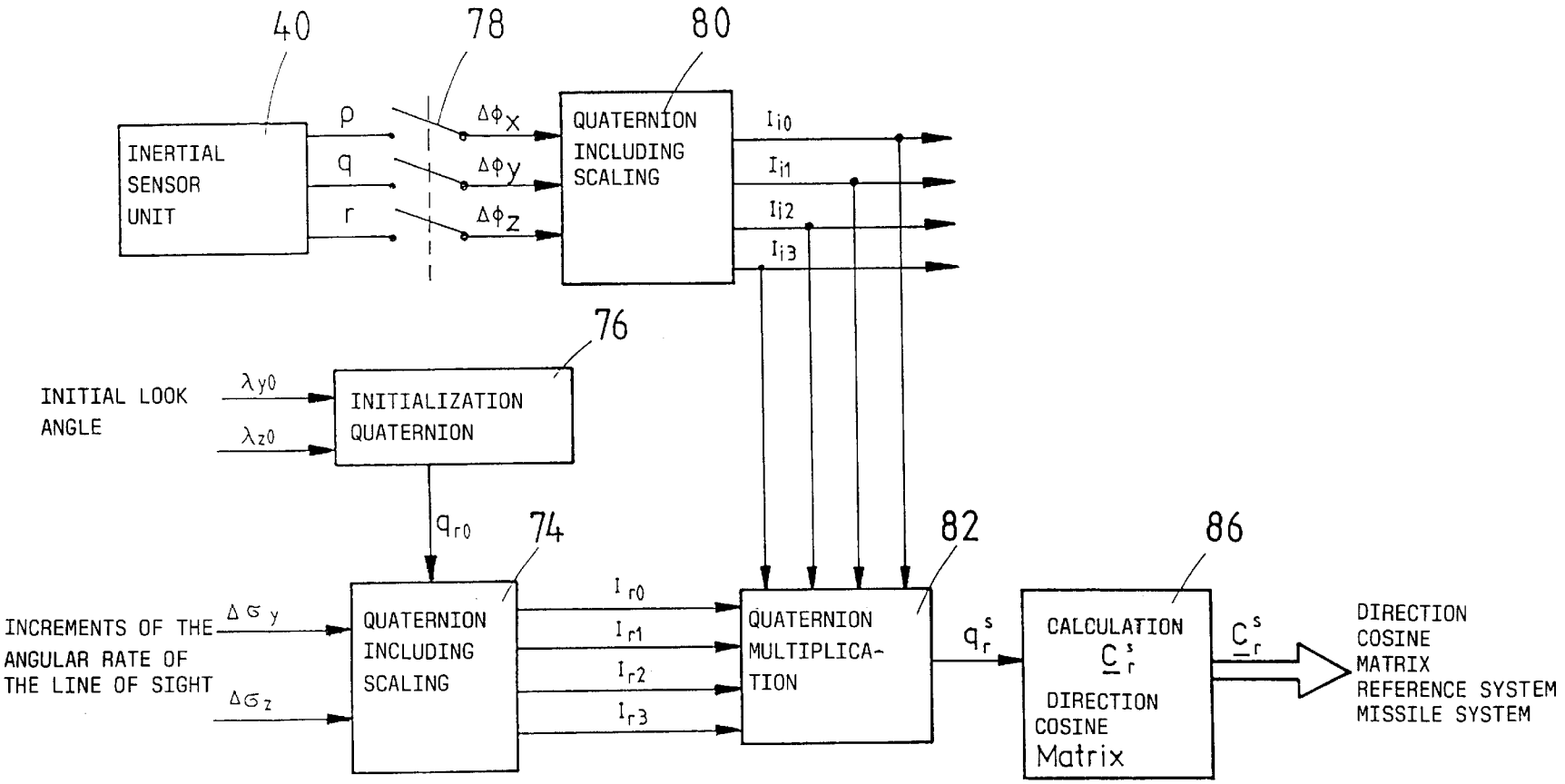

FIG: 4 is a schematic illustration of an infrared-sensitive seeker in a target tracking missile;

FIG. 5 schematically shows the tip of a missile having a seeker head and illustrates the limitation of the look angle;

FIG. 6 is a simplified block diagram and shows the generation of increments of the angular rate of the line of sight for the tracking function of the reference coordinate system; and FIG. 7 is a simplified block diagram and shows the illustration of a missile-fixed system (s) relative to an inertial system and a reference coordinate system (r) relative to the missile system.

DESCRIPTION OF THE PREFERRED EMBODIMENT

Figure 1:
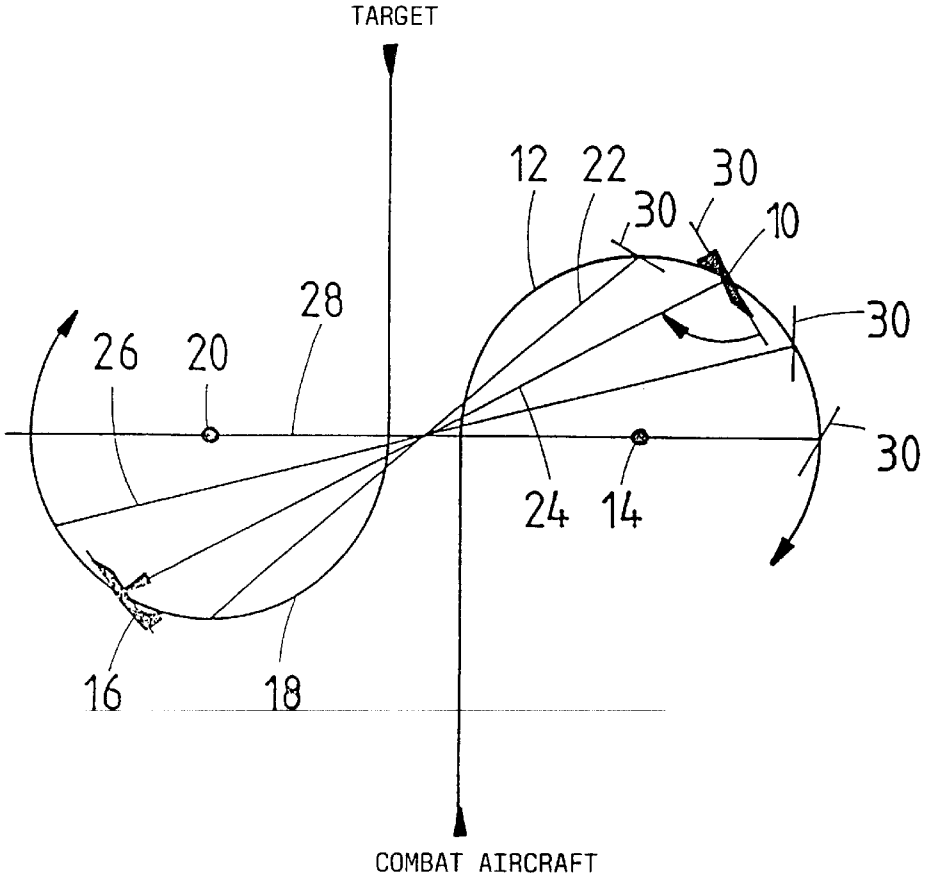
FIG. 1 shows an example of a situation, in which, during air combats with close curves, the tracking function of the seeker to the target and the target designation of a target tracking missile can be deteriorated by limitation of the look angle of the seeker to a maximum allowable value.

Referring now to FIG. 1, there is shown an air combat situation, in which a combat aircraft 10 moves along a narrow circular trajectory 12, which is curved about a point 14. An enemy combat aircraft 16 (target) moves along a likewise narrow circular trajectory 18, which is curved about a point 20 located relatively far away from the point 14. Both of the combat aircrafts 10 and 16 follow the circular trajectories clockwise. On a narrow circular trajectory 12 or 18, the combat aircrafts 10 and 16, respectively, fly with large load factor and, thus, as illustrated, with large angle of attack. This means that the longitudinal axis 30 (aircraft datum line) of the combat aircraft 10 forms an angle with the velocity vector.

Numeral 22, 24, 26 and 28 designate lines of sight from the combat aircraft 10 to the target 16, which lines of sight exist at different moments. It can be seen that the enemy combat aircraft (target) 16 occurs, as seen from the combat aircraft 10, at first at an angle of vision >90°. This results in the line of sight 22. The line of sight 24 extends at an angle of vision of 90° with respect to the longitudinal axis 30 of the combat aircraft 10. With regard to the lines of sight 26 and 28, the angle of vision, at which the enemy combat aircraft 16 occurs to the pilot and to the seeker of a missile provided on the combat aircraft 10, is getting smaller and smaller during the further course of the trajectories 12 and 18. There is a maximum angle of vision, under which the target, namely the enemy aircraft 16, can be designated to the missile by the pilot by means of a helmet visor. This maximum angle of vision for the target designation is, for example, near by 90° and, thus, corresponds to the line of sight 24.

Figure 4:
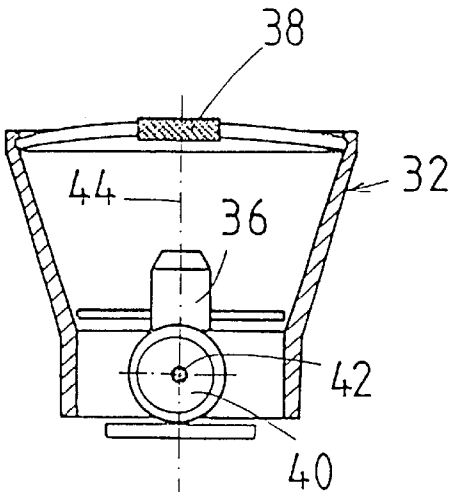

With reference to FIG. 4, there is shown a seeker 32 of a target tracking missile 34 (FIG. 5). The seeker 32 comprises an image resolving detector 36 responding to infrared radiation and an imaging optical system 38. As illustrated in FIG. 5, the seeker 32 is pivotable by a seeker gimbal assembly 40 about a pitch axis 42 relative to the longitudinal axis 44 of the missile 34. Furthermore, a rotation of the seeker 32 about this longitudinal axis 44 (roll axis) is possible. The seeker 32 has an optical axis 46. The angle between the optical axis 46 of the seeker 32 and the longitudinal axis 44 of the missile 34 is called "look angle". Due to the construction the look angle is limited to a "maximum allowable look angle", as can be seen in FIG. 5. The seeker 32 is located behind a transparent dome-shaped window, the "dome" 48, in the tip of the missile 34. The maximum allowable look angle is, for example, determined by the fact that the imaging path of rays of the imaging optical system 38 has to at least partly pass through the dome 48.

The pilot now has to try to catch the enemy combat aircraft 16 as soon as possible, that is at a large angle of vision in the example of FIG. 1, and to designate the target to the target tracking missile 34. The earlier the missile 34 is fired, the larger is the probability of success of shooting down the enemy combat aircraft 16. The limitation of the look angle acts as deterioration.

Figure 2:
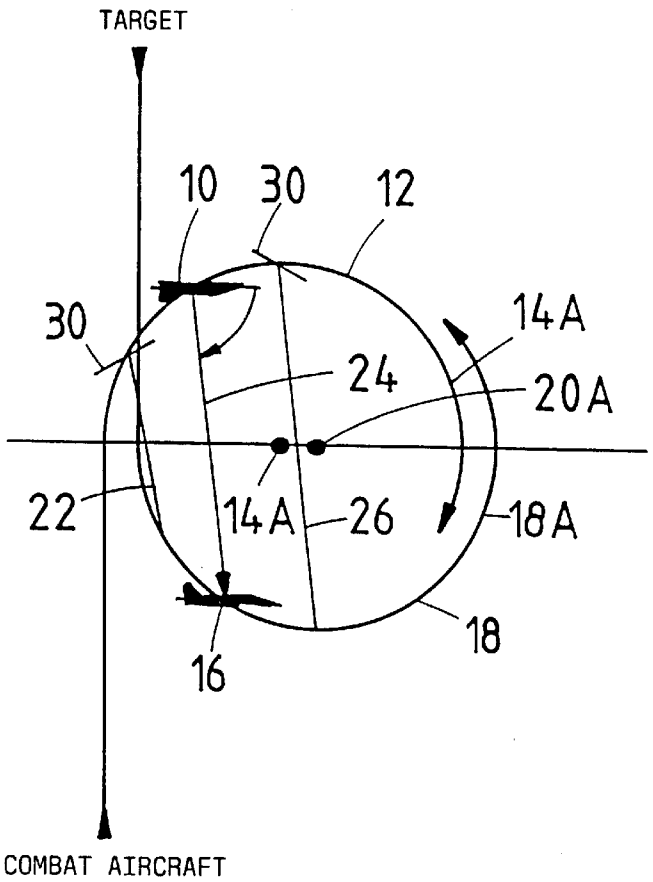
FIG. 2 shows an example of another situation, in which, during air combats with close curves, the tracking function of the seeker to the target and the target designation of a target tracking missile can be deteriorated by limitation of the look angle of the seeker to a maximum allowable value.

FIG. 2 shows a similar air combat situation as in FIG. 1. Corresponding elements are designated by the same reference numerals in FIG. 2 as in FIG. 1. In this air combat situation the points 14A and 20A, about which the two trajectories 14A and 18A are curved, are located close together.

A further problem arises because the missile 34 after the firing and release of the steering system has the tendency to at first be oriented with its longitudinal axis 44 in the direction of the velocity vector 50 of the combat aircraft 10. Thereby, the angle of vision to the target can be increased to an angle, which is larger than the maximum allowable look angle, even if this angle of vision is smaller than the maximum allowable look angle and the seeker 32 of the missile 34 can detect the enemy combat aircraft 16 when the missile 34 is fired.

This is illustrated in FIG: 3. In FIG: 3 the longitudinal axis ("aircraft datum line") of the combat aircraft 10 is designated by 30. A straight line 44A designates the longitudinal axis of the missile 34 (missile boresight") in the launcher, that means before firing. The straight line 44A generally forms a small angle with the longitudinal axis 30. Numeral 54 designates the line of sight from the center of mass of the combat aircraft 10 to the target. This line of sight 54 forms an angle $\alpha$ ("lag angle") with the velocity vector 50. Numeral 58 designates the line of sight from the seeker 32 of the missile 34 to the target. This line of sight 58 is parallel with the line of sight 54 and forms an angle $\beta$ ("missile off-boresight angle at launch") with the longitudinal axis 44A of the missile 34. Numeral 60 designates the line of sight from the helmet visor of the pilot to the target. This line of sight 60 is almost parallel to the lines of sight 54 and 58. The line of sight 60 forms an angle $\gamma$ ("destinator off-boresight angle at launch") with the longitudinal axis 30 of the combat aircraft 10. Numeral 60 designates the line of sight from the seeker 32 of the missile 34 to the target at the time when the control surfaces are unlocked after firing. Also this line of sight 62 is parallel to the lines of sight 54, 58 and 60. The line of sight 62 forms an angle $\delta$ ("off-boresight angle at control unlock") with the longitudinal axis 44 of the missile 34.

Before firing the missile 34, the angle $\beta$ is smaller than the maximum allowable look angle. Therefore, the seeker 32 detects the target and can track the target resulting in a measured angular rate of the line of sight. As can be seen from FIG. 3, the missile 34 is oriented, after the firing, at first with its longitudinal axis 44 substantially in the direction of the velocity vector 50. At the time when the steering is unlocked, the line of sight angle $\delta$ temporarily becomes >90° again and larger than the maximum allowable look angle of the seeker 32 (FIG. 5). The seeker 32 cannot "see" the target anymore. Again, a "deterioration" of the tracking function occurs.

As can be seen from FIG. 5, three coordinate systems are defined, which are represented by their respective x-axes in FIG. 5. A missile coordinate system having the axis $x_5$ is missile-fixed. The $x_s$-axis corresponds to the longitudinal axis 44 of the missile. A seeker coordinate system having the axis $x_h$ is seeker-fixed. The $x_h$-axis corresponds to the optical axis of the seeker 32. A third coordinate system having the axis $x_r$ is a virtual reference coordinate system, which is determined by calculation. Furthermore, there is an inertial system, that means a coordinate system which, with respect to its orientation, is stationary in inertial space.

In FIG. 6 the seeker, that is an image resolving electro-optical unit, is mounted in the missile 34 through a seeker gimbal assembly 40. Numeral 62 designates a missile-fixed inertial sensor unit. The inertial sensor unit 62 can be constructed with gyros, laser gyros or other inertial sensors responding to angular rates. The inertial sensor unit 62 supplies angular rates p, q and r about three missile-fixed axes.

The seeker 32 supplies image data at an output 64. The image data are applied to an image processing system 66. The image processing system 66 supplies deviation data corresponding to a target deviation in the seeker-fixed coordinate system, which deviation data can be represented by a vector $\epsilon^h$. These deviation data $\epsilon^h$ are applied to means 68 for coordinate transformation. The means 68 for coordinate transformation receive, on one hand, gimbal angles from the seeker gimbal assembly, as illustrated by the connection 70. On the other hand, the means 68 for coordinate transformation also receive direction cosine data corresponding to a direction cosine matrix $C_r^s$. The direction cosine matrix $C^s_r$ represents the rotation from the reference coordinate system to the seeker coordinate system, as will be described later. The means 68 for coordinate transformation then supply deviation data with respect to the reference coordinate system. These deviation data $\epsilon^r$ are applied to an estimator filter 72. The estimator filter 72 supplies increments $\Delta\sigma_y$ and $\Delta\sigma_z$ of the angular rate of the line of sight.

The increments $\Delta\sigma_y$ and $\Delta\sigma_z$ of the angular rate of the line of sight are applied to means 74 for defining a reference coordinate system. Initial look angles $\lambda_{y0}$ and $\lambda_{z0}$ are applied to means 76 for defining an initial position of the reference coordinate system. In this initial position of the reference coordinate system the look angles $\lambda$ are still smaller than the maximum allowable look angle. The seeker 32 still detects the target. The data of the initial position of the reference system are likewise applied to the means 74 for defining the reference coordinate system.

In the illustrated preferred embodiment, the reference coordinate system is represented by a quaternion having the elements $I_{r0}$, $I_{r1}$, $I_{r2}$ and $I_{r3}$. Correspondingly, also the initial position of the reference coordinate system is represented by a quaternion $q_{r0}$. The means 74 for defining the reference coordinate system, at the same time, achieve scaling.

The inertial sensor unit 40 supply the three angular rates p, q and r about three missile-fixed axes. The scanning of the angular rates p, q and r in a fixed clock cycle supplies angle increments $\Delta\Phi_x$, $\Delta\Phi_y$ and $\Delta\Phi_z$. The scanning with a fixed clock cycle is symbolized in FIG. 7 by a three-pole switch 78. The angle increments $\Delta\Phi_x$, $\Delta\Phi_y$ and $\Delta\Phi_z$ are applied to means 80 for representing a missile coordinate system. The position of the missile coordinate system is related to an inertial system. The missile coordinate system is likewise defined by a quaternion. This quaternion has the elements $I_{i0}$, $I_{i1}$, $I_{i2}$ and $I^{i3}$.

The quaternion from the means 74 representing the reference coordinate system and the quaternion from the means 80 representing the missile coordinate system, that means the elements $I_{i0}$, $I_{i1}$, $I_{i2}$ and $I_{i3}$ are "multiplied" by multiplication means 82. The multiplication of the quaternions supply the relative position of the missile coordinate system and the reference coordinate system. This is represented by a quaternion $q_r^s$.

The quaternion $q_r^s$ representing the relative position between the missile coordinate system and the reference coordinate system is likewise applied to means 86 for forming the associated direction cosine matrix $C_r^s$.

The direction cosine matrix $C_r^s$ provides the position of the reference coordinate system relative to the missile. As illustrated in FIG. 6, this direction cosine matrix $C_r^s$ is applied to means 68 for coordinate transformation. Thus, these means 68 for coordinate transformation provide the deviation data with respect to the reference coordinate system. From the elements of the direction cosine matrix $C_r$control signals for the seeker gimbal assembly 40 are obtained, such that this movement of the missile 34 is compensated for at the seeker 32 and the seeker 32 is decoupled from the movements of the missile 34.

The described seeker head operates as follows:

In the normal operation, when the seeker 32 detects the target and follows it with a look angle smaller than the maximum allowable look angle, the seeker coordinate system with axis $x_h$ and the reference coordinate system with the axis $x_r$ approximately coincide. When the seeker 32 has reached the maximum allowable look angle, then the seeker 32 is stopped in its position. The reference coordinate system, however, moves further relative to the missile 34. This movement is determined by the angular rate of the line of sight, which was valid when the maximum allowable look angle had been attained. This angular rate of the line of sight supplies further increments $\Delta\Phi_y$ and $\Delta\Phi_z$ to the means 74 for defining the reference coordinate system in inertial space. By this, the reference coordinate system is tracked to a predicted position of the target. It is assumed that the angular rate of the line of sight in inertial space substantially remains constant for a short period of time. The predicted positions are obtained by a kind of extrapolation. By the multiplication of the quaternions by means of the multiplication means 82, the position of the reference coordinate system relative to the missile is obtained. When the thus calculated look angle of the reference coordinate system becomes smaller than the maximum allowable look angle again, then the real seeker 32 is aligned according to this reference coordinate system. Thus, the seeker 32 is directed to the predicted positions of the target. It can be assumed that these predicted positions are located in the proximity of the real target and, thus, the target is detected in the field of view of the seeker 32 again.

Figure 3:
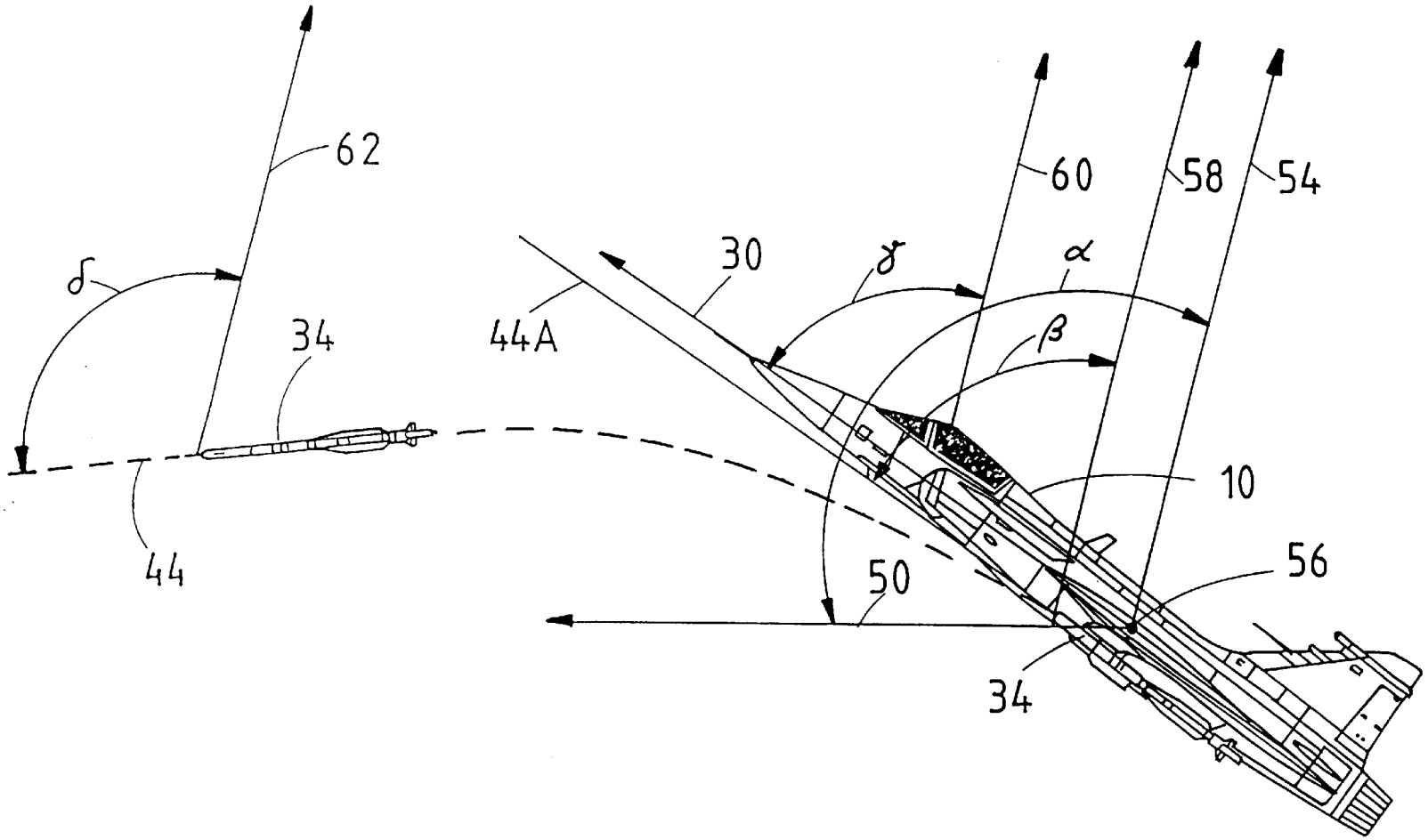
FIG. 3 shows the geometry when a missile is fired by an aircraft.

In the situation illustrated in FIG. 3, the seeker 32 at first loses the target after the firing of the missile 34, because the angle of vision $\delta$ to the target is increased beyond the maximum allowable look angle of the seeker 32 due to the alignment of the seeker 34 with the velocity vector 50. The axis $x_r$ of the reference system is, as described, aligned to the predicted position of the target. However, after the control surfaces has been unlocked, the missile 34, taking the last angular rate of the line of sight measured by the seeker 32 as a basis, is guided such that it tracks the target. Thus, the missile 34 is rotated to the direction to the target. Thereby, the "angle of vision" of the "virtual seeker" represented by the reference coordinate system is reduced again. The angle of vision falls below the maximum allowable look angle. Due to this, as described, the seeker 32 can be aligned according to the reference coordinate system again and can detect the target.

The use of quaternions for representing the coordinate systems avoids singularities, which would appear at a took angle of 90° when using other representations.

I claim:

1. A seeker head for target tracking missiles, comprising:

an image resolving seeker gimbal suspended in a seeker gimbal assembly;

means for aligning said image resolving seeker to a target by target deviation signals;

inertial sensors;

means for defining a inertially stabilized reference coordinate system from signals from said image resolving seeker and from said seeker gimbal assembly, said stabilized reference coordinate system having an axis pointing to said target;

means for pointing said stabilized reference coordinate system to predicted target positions, in case of deterioration of a target-tracking function of said seeker, in accordance with line of sight information of said reference coordinate system then present; and means for aligning said seeker with said axis of said reference coordinate system, when said deterioration ceases, said signals from said seeker then resuming the tracking function of said seeker again.

2. The seeker head of claim 1, wherein said deterioration consists of limitation of the movement of said seeker to a maximum look angle and said seeker is stopped in its position when said maximum look angle is attained, and said seeker is aligned with said axis of said reference coordinate system when said look angle of said axis falls below said maximum look angle.

3. The seeker head of claim 1, further comprising:

means for coordinate transformation of target deviation data from a seeker coordinate system to said reference coordinate system for generating transformed deviation data;

an estimator filter to which said transformed target deviation data are applied for generating increments of the angular rate of said line of sight; and means for defining said reference coordinate system, said increments of the angular rate of said line of sight being applied to said means for defining said reference coordinate system.

4. The seeker head of claim 3, wherein initial look angles of said seeker are applied to said means for defining said reference coordinate system when said seeker is aligned to said target.

5. The seeker head of claim 4, wherein gimbal angles of said seeker gimbal assembly are applied to said means for coordinate transformation.

6. The seeker head of claim 1, wherein said reference coordinate system is defined by a quaternion.

7. The seeker head of claim 6, further comprising means for multiplying said two quaternions representing said reference coordinate system and said missile coordinate system for generating a further quaternion representing the relative position of said missile coordinate system and said reference coordinate system.

8. The seeker head of claim 7, wherein said alignment of said seeker with said reference coordinate system is controlled in dependence of said further quaternion after said deterioration has ceased.

9. The seeker head of claim 1, further comprising means for defining a missile coordinate system, angle increments from said inertial sensors being applied to said means for defining a missile coordinate system, said missile coordinate system representing the attitude of said missile relative to an inertial system.

10. The seeker head of claim 9, wherein said missile coordinate system is defined by a quaternion.

* * * * *